US009679462B1

(12) United States Patent
Robertson

(10) Patent No.: US 9,679,462 B1
(45) Date of Patent: Jun. 13, 2017

(54) WIRELESS WAKE-UP ALARM WITH OCCUPANT-SENSING APPARATUS

(71) Applicant: Christopher Robertson, Newark, CA (US)

(72) Inventor: Christopher Robertson, Newark, CA (US)

( * ) Notice: Subject to any disclaimer, the term of this patent is extended or adjusted under 35 U.S.C. 154(b) by 0 days.

(21) Appl. No.: 14/975,791

(22) Filed: Dec. 20, 2015

(51) Int. Cl.
*G08B 23/00* (2006.01)
*G08B 21/22* (2006.01)

(52) U.S. Cl.
CPC ..... *G08B 21/22* (2013.01)

(58) Field of Classification Search
None
See application file for complete search history.

(56) References Cited

U.S. PATENT DOCUMENTS 5,764,153 A 6/1998 Vedaa
6,239,706 B1 5/2001 Yoshiike
7,253,366 B2 * 8/2007 Bhai ..... A61B 5/1115 177/144
8,466,801 B2 6/2013 Hayes
2003/0209893 A1 * 11/2003 Breed ..... B60J 10/00 280/735
2011/0085423 A1 4/2011 Cottrell
2012/0212582 A1 * 8/2012 Deutsch ..... G08B 21/245 348/46

OTHER PUBLICATIONS

U.S. Appl. No. 62/089,867, filed Dec. 23, 2014 by Christopher Robertson (myself).

* cited by examiner

*Primary Examiner* — Adolf Dsouza

(57) ABSTRACT

A wake-up alarm with occupant-sensing apparatus attached to a bed which is configured via wireless protocol with a personal computing device of the occupant of the bed. During an alarm period, defined by a turn-on time and turn-off time, the alarm will emit an alarm sound when an occupant is detected in the bed. During the alarm period, the alarm cannot be disabled.

4 Claims, 6 Drawing Sheets

WIRELESS WAKE-UP ALARM WITH OCCUPANT-SENSING APPARATUS

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

CROSS-REFERENCE TO RELATED APPLICATIONS

This application claims the benefit of PPA No. 62/089,867, filed on 2014 Dec. 23 by the present inventor, which is incorporated by reference.

SEQUENCE LISTING OR PROGRAM

This patent application includes 2 programs attached as ASCII text files. The first program is a Java-language program listing for a Google Android-capable computing device. The program was developed using Android Developer Tools (Build version 22.2.1-833290) ©2015 Chris Robertson (17 U.S.C. 401). The second program is a C-language program listing for an NXP LPC1114FN28 microcontroller. The program was developed using LPCXpresso version 5.0.14 (Build 1109, 2012 Dec. 19) ©2015 Chris Robertson (17 U.S.C. 401).

BACKGROUND—PRIOR ART

The following is a tabulation of some prior art that presently appears relevant:

U.S. Patents

| U.S. Pat. No. | Kind Code | Issue Date | Patentee |
|---|---|---|---|
| 6,239,706 | B1 | 2001 May 29 | Nobuyuki Yoshiike, Shigeyuki Inoue, Kazuhiko Hashimoto |
| 7,253,366 | B2 | 2007 Aug. 7 | Aziz A. Bhai |
| 8,466,801 | B2 | 2013 Jun. 18 | Stephen Hayes, Stephen Hollyoak |
| 5,764,153 | A | 1998 Jun. 9 | Richard M. Vedaa |

U.S. patent application Publications

| Publication Nr. | Kind Code | Publ. Date | Applicant |
|---|---|---|---|
| 20110085423 | A1 | 2011 Apr. 14 | Brian Cottrell |

A traditional alarm clock is minimally comprised of a display, a speaker, and controls to configure the current time, an alarm turn-on time, and a switch to enable or disable the alarm function. Traditional alarm clocks do not include any feature to prevent a bed's occupant from oversleeping past a designated alarm turn-on time. The occupant can disable or reset a triggered alarm and oversleep past the originally designated alarm turn-on time.

Nobuyuki et al disclose a system to determine a bed occupant's load and sleep state. The system was designed to operate in a hospital setting only. The alarm is only designed to alert a caregiver acting in a monitoring role. The alarm is not designed to perform a wake-up function.

Bhai discloses a system designed to emit an alarm if an occupant is exiting a bed. The system was designed to operate in a hospital setting only. The alarm is only designed to alert a caregiver acting in a monitoring role. The alarm is not designed to perform a wake-up function.

Hayes et al disclose a system to emit an alarm if excessive movement is detected. The system was designed to operate in a hospital setting only. The alarm is only designed to alert a caregiver acting in a monitoring role. The alarm is not designed to perform a wake-up function.

Vedaa discloses a conventional alarm clock with a pressure-controlled mechanical switch which does not prevent the occupant from disabling a triggered alarm. The occupant must manually calibrate the sensitivity of the mechanical switch by process of trial-and-error. The switch can only detect an occupant's weight in a limited region of an entire sleeping surface.

Cottrell discloses an alarm clock which uses a single load cell sensor placed under a single bedpost. Placing a rigid load cell assembly under a rigid bed frame structure will create an uneven weight distribution over the bed frame and bedposts. This will cause wobbliness of the entire bed structure and excessive weight-related damage to the bed frame. An occupant can bypass the weight sensor by shifting his or her weight away from the weight sensor and closer to a bedpost without an attached sensor.

Cottrell describes a sensor circuit comprised of a voltage divider circuit with no amplification method. This type of circuit has the inherent disadvantages of low sensitivity and low measurement accuracy. This type of circuit is also susceptible to inaccurate measurements due to temperature fluctuation. Cottrell describes controls that includes an on/off switch for the alarm whereby even if the occupant has not left the bed, he or she can disable the alarm and oversleep past the originally designated alarm turn-on time.

All wake-up alarms heretofore known suffer from a number of disadvantages:

a) They can be disabled by the occupant after the alarm turn-on time has elapsed.

b) Their manufacture requires the inclusion of a display to show the current time thereby increasing manufacture cost.

c) Their manufacture requires the inclusion of an input device to configure the current time, alarm turn-on time, and other alarm settings thereby increasing manufacture cost.

SUMMARY

In accordance with one embodiment a wake-up alarm comprises a wireless alarm-control device, an occupant-sensing apparatus, a wireless communication apparatus, and software for a personal computing device. An alarm is configured by an occupant via wireless communication with the occupant's personal computing device. The occupant configures each alarm by designating a turn-on time and a turn-off time.

Advantages

Accordingly several advantages of one or more aspects are as follows: to provide a wake-up alarm that will prevent a bed's occupant from disabling or resetting a triggered alarm, that can only be silenced by the occupant exiting the bed at the originally designated alarm turn-on time, that does not require an integrated display to show the current time, that does not require integrated input controls to configure alarm settings, that can be simultaneously configured for multiple alarms, that will prevent unauthorized tampering of alarm settings, and that can be used to track sleep-related data for medical purposes. Other advantages of one or more aspects will be apparent from a consideration of the drawings and ensuing description.

DRAWINGS—FIGURES

DRAWINGS—REFERENCE NUMERALS

Figure 1:
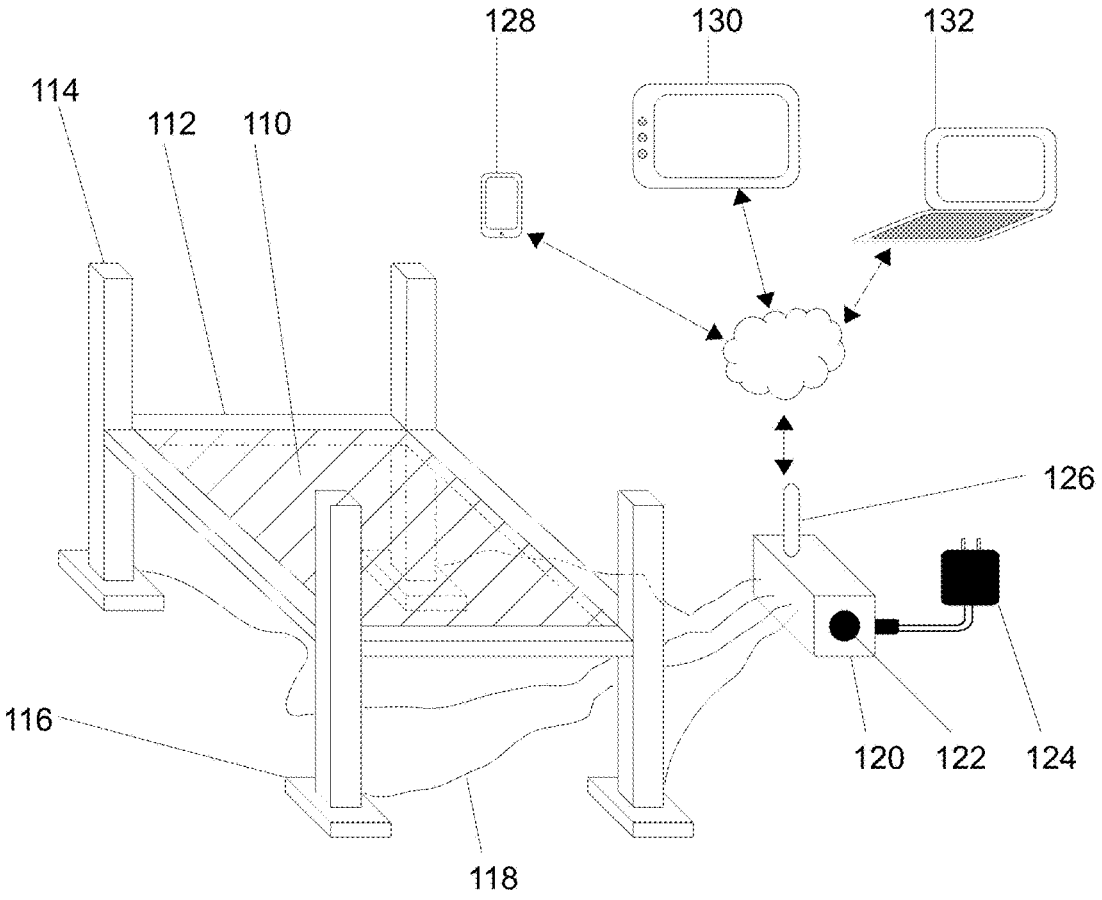
FIG. 1 is a perspective view of one embodiment of a wireless wake-up alarm with occupant-sensing apparatus.

110 Sleeping surface of a bed
112 Bed frame
114 Bedpost
116 Load cell assembly
118 Cable connecting load cell circuit to wireless alarm control device
120 Wireless alarm control device
122 Speaker of the wireless alarm control device
124 AC-to-DC power supply
126 Antenna for wireless communication
128 Smartphone
130 Tablet computer
132 Notebook computer
134 Dashed line indicating power connection
136 Solid line indicating data connection
138 Dot-dot-dashed line indicating wireless data connection

DETAILED DESCRIPTION—First Embodiment—FIGS. 1, 2, 3, and 4

FIG. 1 shows a perspective view of the physical structure of the first embodiment of a wireless wake-up alarm with occupant-sensing apparatus. The sleeping surface 110 supports a bed's occupant or occupants. Attached to the sleeping surface is the bed frame 112. The bedposts 114 support the bed frame. Underneath each bedpost 114 is a removable strain gauge load cell assembly 116. Each load cell assembly 116 is connected by a cable 118 to the wireless alarm control device 120.

The wireless alarm control device 120 includes a speaker 122, a power supply 124, and an antenna 126 to enable wireless communication. The wireless alarm control device is accessed by the occupant of the bed using the occupant's wireless-capable personal computing device. Examples of a wireless-capable personal computing device include, but is not limited to, a smartphone 128, a tablet computer 130, and a notebook computer 132.

Figure 2:
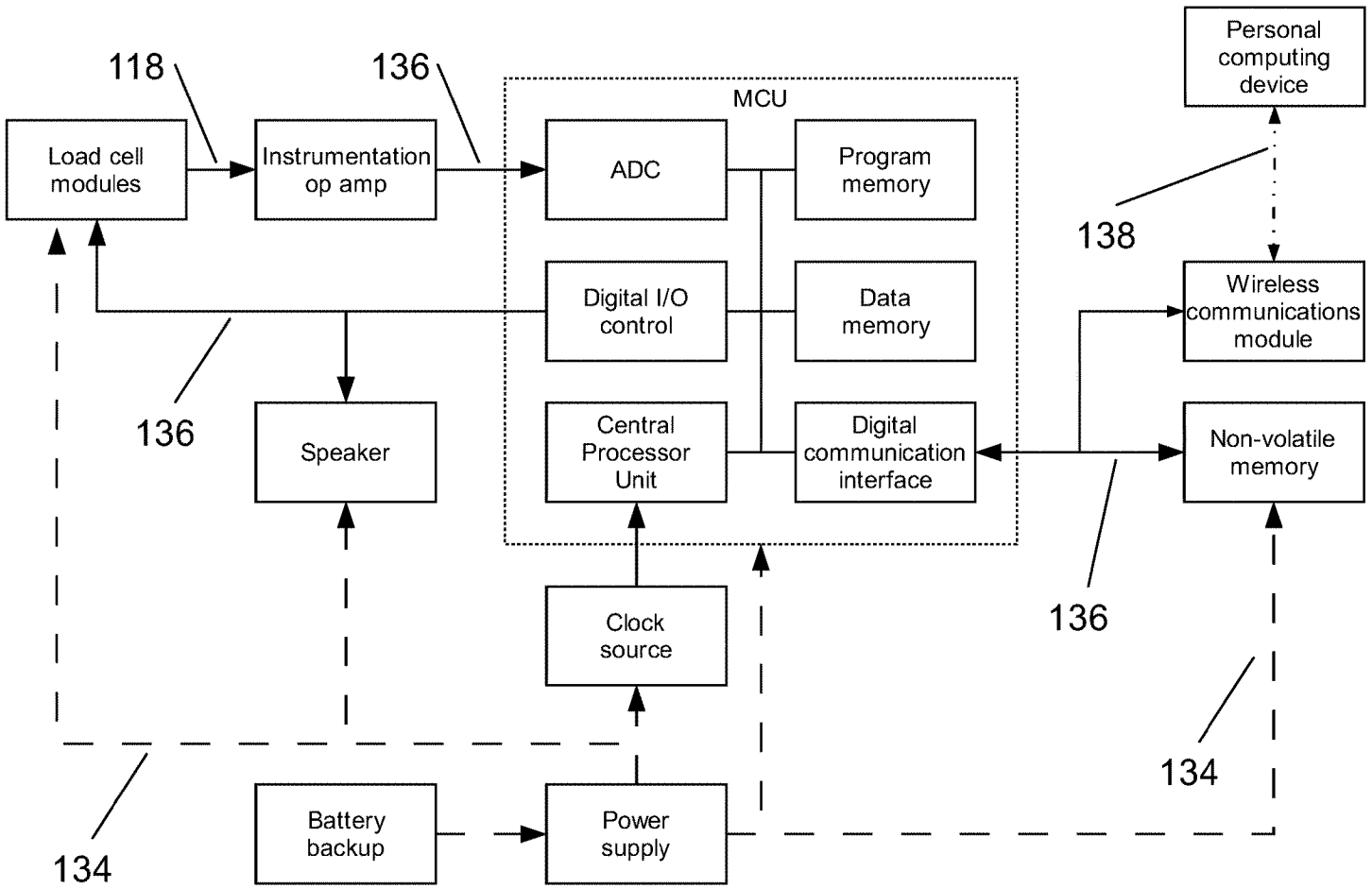
FIG. 2 is a block diagram of the hardware for one embodiment of a wireless wake-up alarm with occupant-sensing apparatus.

FIG. 2 shows a block diagram of the hardware of the first embodiment of a wireless wake-up alarm with occupant-sensing apparatus. The circuit of each load cell module is connected to a separate instrumentation operational amplifier via cable 118. Each instrumentation operational amplifier is connected to a separate input of the ADC (analog-to-digital converter) hardware of the MCU (micro-controller unit). Some of the more important components of an MCU include the ADC, digital I/O (input/output) control, CPU (central processor unit), program memory, data memory, and digital communication interfaces.

Hardware includes a speaker circuit, a clock source, non-volatile memory, and a wireless communication module. These components are connected to the MCU via data lines indicated by solid lines 136. The power supply and battery backup provide power to all components of the hardware via power connections indicated by dashed lines 134. The wireless communication module communicates with a software program operating on a personal computing device via wireless communication indicated by a dot-dot-dashed line 138. The software program on the personal computing device is designed to access and communicate with the software program of the MCU.

Figure 3:
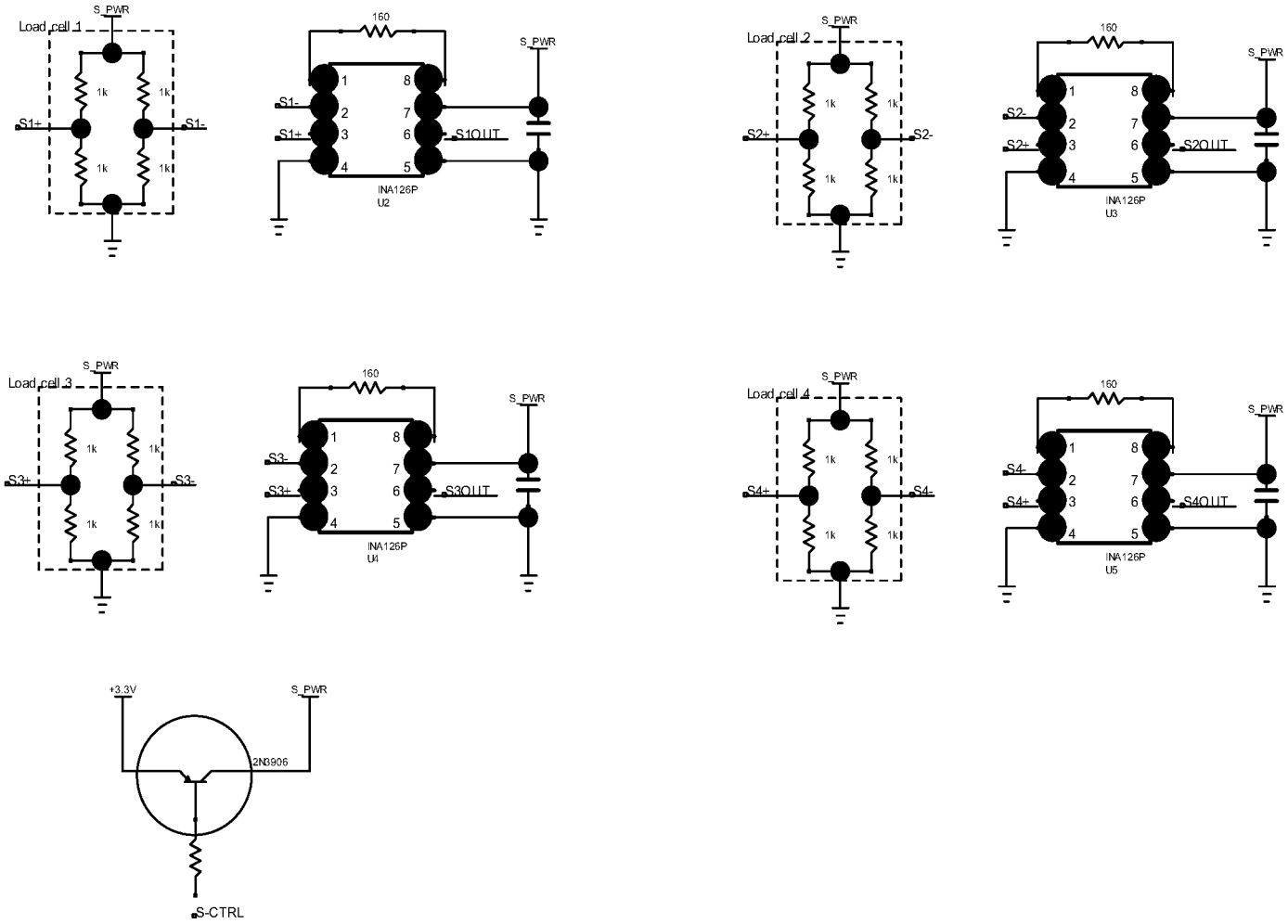
FIG. 3 is a circuit schematic of a load cell and instrumentation operational amplifier circuits for one embodiment of a wireless wake-up alarm with occupant-sensing apparatus.

FIG. 3 shows a detailed circuit schematic for the first embodiment of the wireless wake-up alarm with occupant-sensing apparatus' load cell and instrumentation operational amplifier (U2-U5) circuit for each bedpost. The power to each load cell and instrumentation operational amplifier is controlled by the S-CTRL signal to the high-side PNP transistor 2N3906. Each load cell circuit is a Wheatstone bridge located in the load cell assembly 116. The positive and negative outputs of each load cell circuit are connected to the inputs of the instrumentation operational amplifier via cable 118. The gain resistor of the instrumentation operational amplifier is 160 Ohms. The output of each instrumentation operational amplifier is connected to the ADC inputs of FIG. 4.

Figure 4:
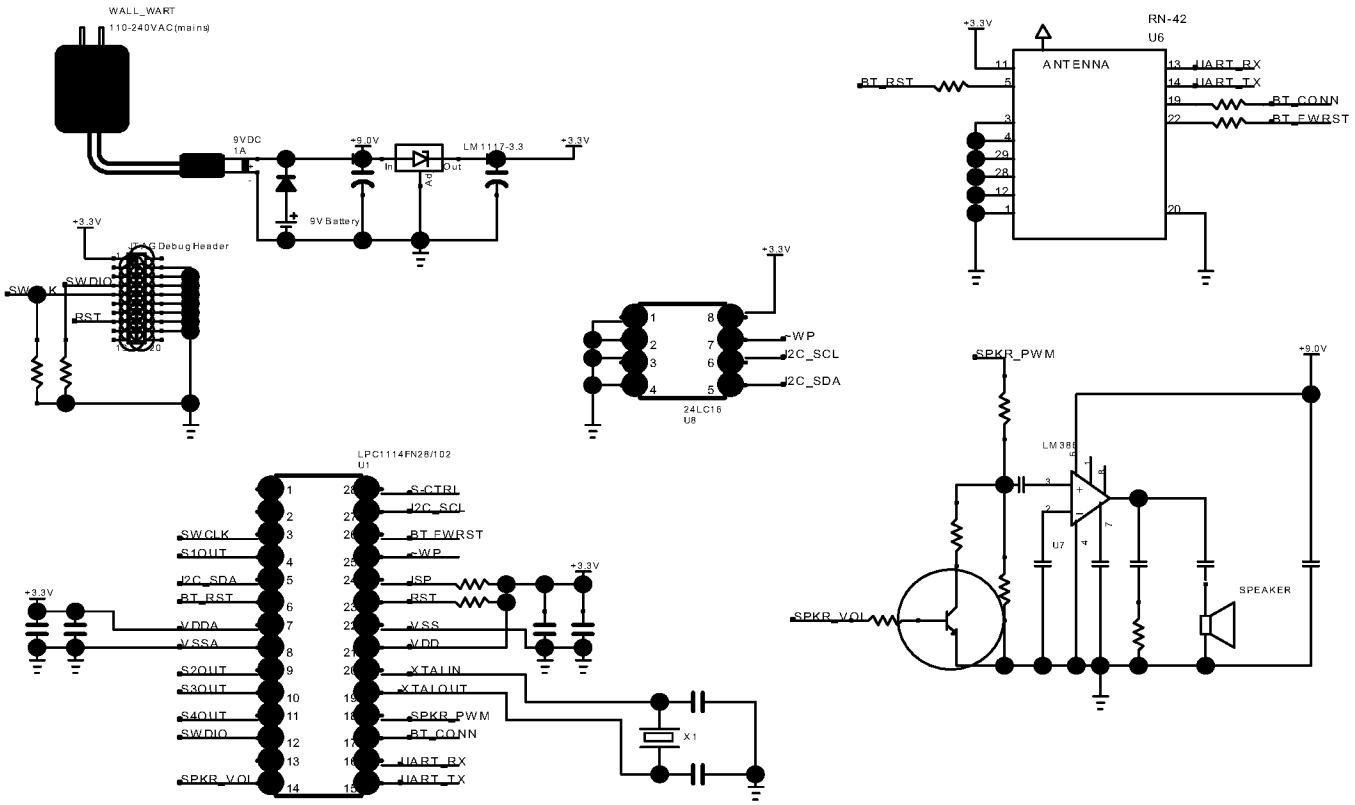
FIG. 4 is a circuit schematic for alarm control, non-volatile memory, wireless communication, power supply, backup battery, and programming-connector circuits for one embodiment of a wireless wake-up alarm with occupant-sensing apparatus.

FIG. 4 shows a detailed circuit schematic for the first embodiment of the wireless wake-up alarm with occupant-sensing apparatus' alarm, memory, power, and communication control circuits. A wall wart AC-to-DC power supply converts AC mains power to 9 volts DC for the +9.0V bus. A backup battery is connected via diode to the same bus to provide power when the alarm is in operation and the power supply is disconnected. 9 volt power is converted to 3.3 volts via an LM1117 voltage regulator. The +3.3V bus provides power to the load cell and instrumentation operational amplifiers (U2-U5) of FIG. 3. The +3.3V bus also provides power to the LPC1114FN28 MCU (U1), Bluetooth wireless communication module (U6), and an external EEPROM non-volatile memory module (U8). The +9.0V bus is connected to the speaker amplifier LM386 (U7).

The MCU (U1) controls the load cell and instrumentation operational amplifier power via S-CTRL (pin 28). The sensor output is connected to ADC inputs on pins 4, 9, 10, and 11. The MCU can send and receive data to the Bluetooth communication module (U6) via UART transmit (pin 15) and receive (pin 16). The MCU detects the Bluetooth connection status on BT_CONN (pin 17). The MCU can reset the Bluetooth communication hardware via BT_RST (pin 6) and reset the Bluetooth communication module's software configuration via BT_FWRST (pin 26).

The MCU (U1) controls the alarm speaker amplifier (U7) via SPKR_PWM (pin 18). The MCU controls the alarm speaker volume via SPKR_VOL (pin 14). The MCU communicates with the EEPROM (U8) via I2C (inter integrated circuit) protocol on I2C_SDA (pin 5) and I2C_SCL (pin 27). The MCU program can be reprogrammed via SWCLK (pin 3), SWDIO (pin 12), and RST (pin 23) on the JTAG debug header. The MCU pin configuration can be reset using the ISP (pin 24). A crystal oscillator X1 provides an accurate clock signal to MCU pins 19 and 20.

Operation—First Embodiment—FIGS. 1, 3, 4, 5, and 6

In one embodiment of the wireless wake-up alarm with occupant-sensing apparatus of FIG. 1, the occupant connects AC mains power 124 and the backup battery to the wireless alarm-control device. The load cell assemblies 116 are separate apparatuses from the bed and the occupant manually inserts a load cell assembly underneath each bedpost. The occupant has the option to permanently attach each load cell to a bedpost using screws or some other locking mechanism. The load cell assemblies support 100 percent of the weight of the sleeping surface and occupant or occupants of the bed.

Power is supplied to all load cell assemblies simultaneously via S-CTRL digital I/O signal from the MCU of FIG. 4. Power is supplied to each load cell circuit via cable 118 of FIG. 1. A differential analog signal from the Wheatstone bridge circuit of each load cell assembly is amplified by the instrumentation operational amplifier circuit in FIG. 3 and connected to the ADC inputs of FIG. 4. The output of the ADC represents the measured weight which is applied to each separate load cell assembly.

Figure 5:
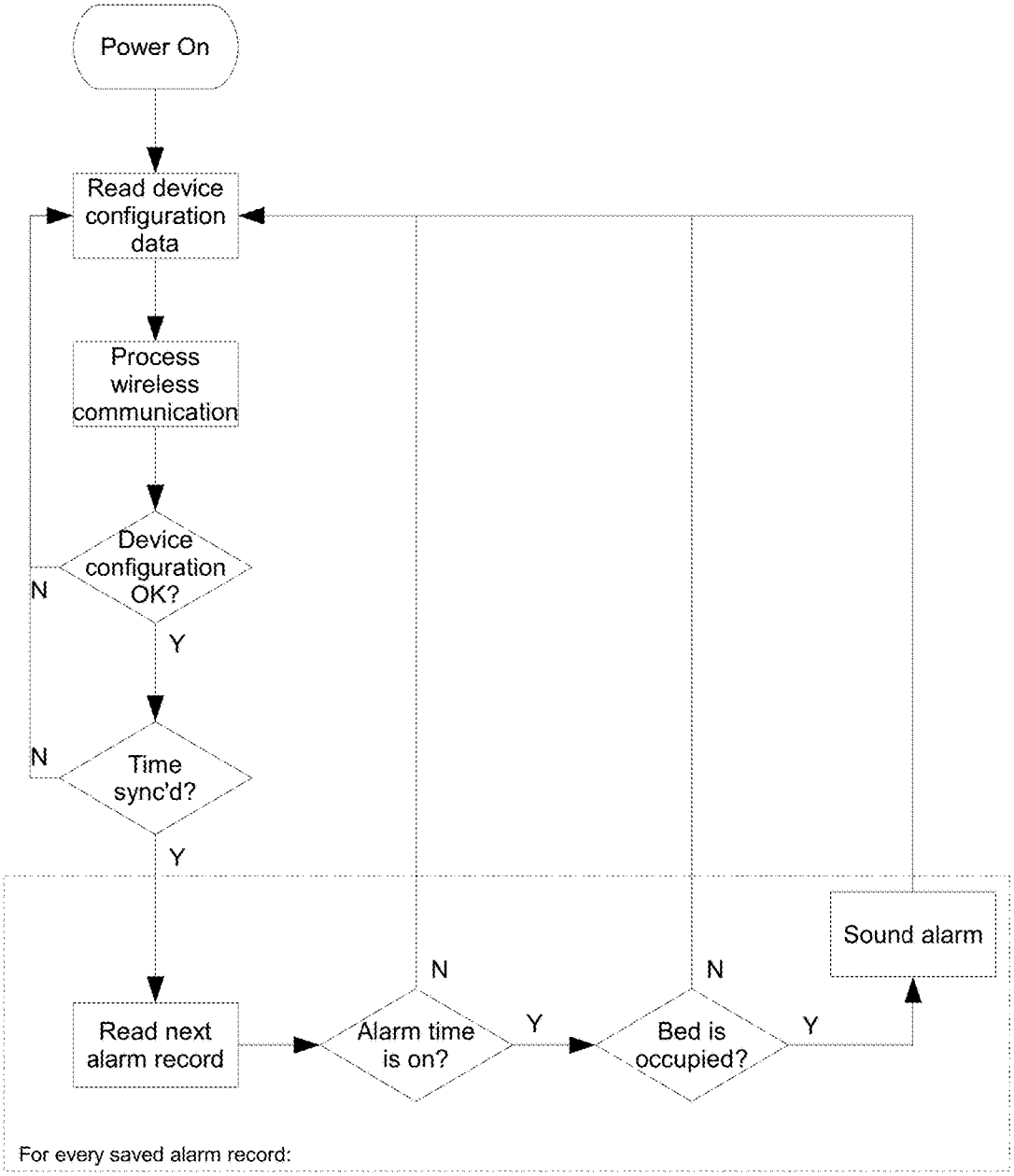
FIG. 5 is a software flowchart describing the high-level operation of one embodiment of a wireless wake-up alarm with occupant-sensing apparatus.

When power is connected to the wireless alarm-control device 120, the MCU executes the software program of FIG. 5. The MCU reads device configuration data stored on the EEPROM (U8) of FIG. 4 via I2C protocol. The MCU then processes any wireless communication that may have occurred. Among other configuration parameters, the weight of the bed without any occupants is required to complete device configuration. After the device is powered, the local time of the device is synchronized at least once to the current time of the occupant's personal computing device.

If the device has not been configured or the local time has not been synchronized, then the MCU will not process any alarms and will wait until the occupant configures these two parameters. The wireless alarm-control device is automatically synchronized by any incoming wireless communication from the occupant's personal computing device. The occupant can configure the weight of the empty bed using the software program described in FIG. 6.

If the occupant has configured the device and the local time has been synchronized, then the MCU will begin processing alarms saved on the device. Multiple alarm records can be saved on a single wireless alarm-control device 120. Among other alarm record parameters, an occupant defines an alarm period using an alarm turn-on time and an alarm turn-off time. During this alarm period, the alarm will emit sound if an occupant is detected in the bed. During this alarm period, the alarm will be silent if no occupant is detected in the bed. Not during this alarm period, the alarm will be silent. The MCU will continually process each saved alarm record according to this algorithm.

The MCU can detect whether or not an occupant is in bed by comparing the currently measured weight of the bed with the preconfigured weight of the empty bed. If the value of this difference exceeds a preset sensitivity threshold value, then the bed is considered to be occupied. The preset sensitivity threshold values can be preconfigured by the occupant of the bed using the software program described in FIG. 6. The preset sensitivity threshold values can be adjusted so that light items such as bedding and luggage will not cause the false detection of an occupant.

Figure 6:
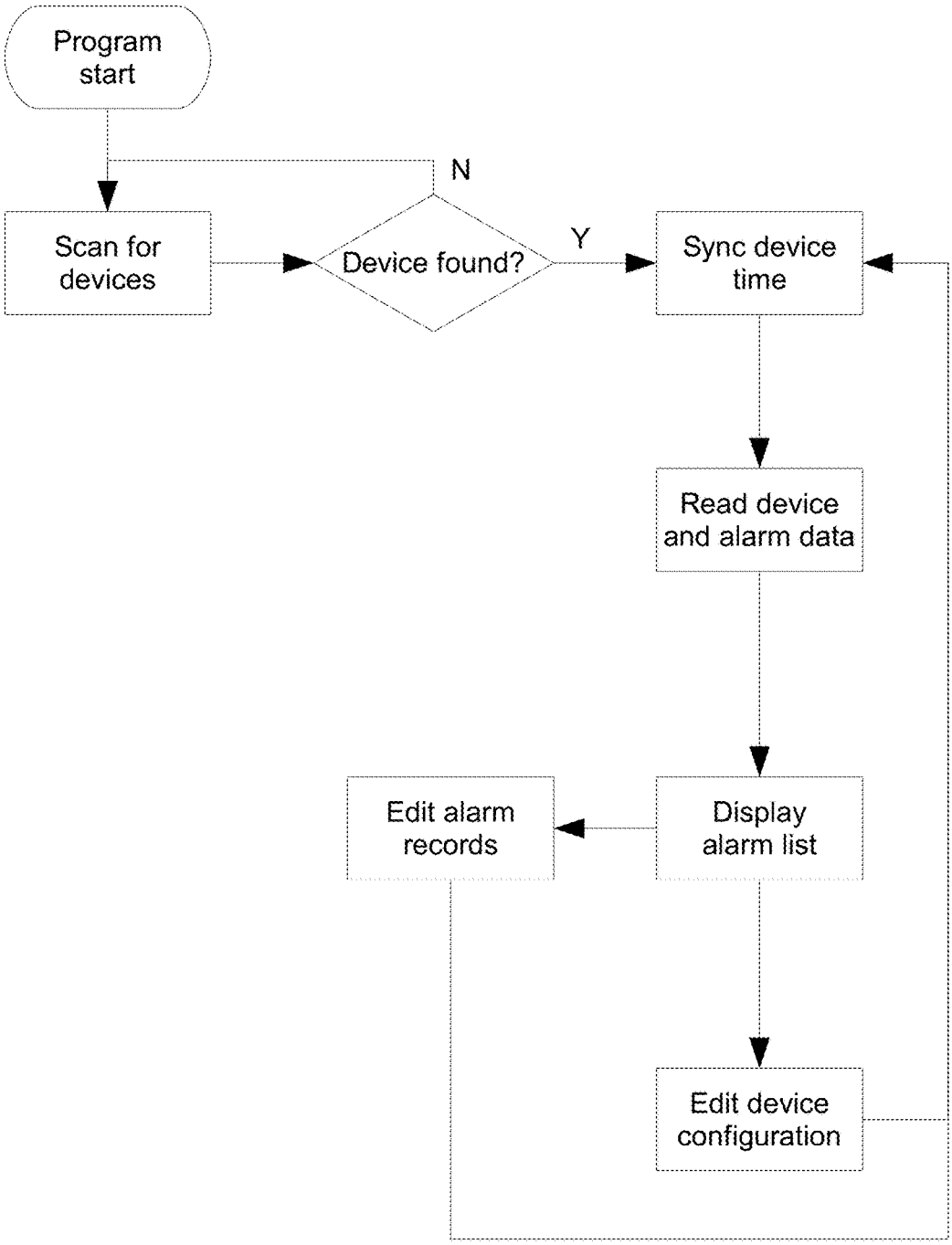
FIG. 6 is a software flowchart describing the high-level operation of one embodiment of the software program for a personal computing device designed to communicate via wireless protocol with a wireless wake-up alarm with occupant-sensing apparatus.

FIG. 6 shows how the software program of the occupant's personal computing device can access and modify the alarm records or device configuration of the wireless alarm-control device 120. The occupant manually starts the program designed to communicate with the wireless alarm-control device. The program scans for a device until a device is found. The program then connects to the device.

After connecting to the device, the program automatically transmits a current time stamp in order to synchronize the device time to the current time of the personal computing device. The program reads the device configuration and alarm records from the device. The program displays the current alarm list to the occupant of the bed. From this list, the occupant can edit or delete a saved alarm record or add a new record. Also from this list, the occupant can edit the configuration of the device. After each action by the occupant, the program resynchronizes the device's local time and rereads the modified configuration and alarm records from the device. The occupant can halt execution of the program at any time.

The occupant can use the program of FIG. 6 to configure the following parameters of an alarm record (not shown):

- Name for the alarm
- Type of alarm: a single date or recurring days of the week
- Turn-on time for the alarm period
- Turn-off time for the alarm period
- Alarm volume
- Alarm sound-pattern The occupant can use the program of FIG. 6 to configure the following parameters of the wireless alarm-control device (not shown):

- Metric or imperial unit of measurement
- Number of sensors (dependent on the number of bedposts of the bed in question)
- Sensitivity threshold value
- Calibrate the sensors to the weight of the empty bed During an alarm period, the MCU will not allow any action to disable the alarm. The MCU will not allow any action to edit or delete the alarm record. The MCU will also not change sensitivity threshold value configuration parameters or any configuration parameter which affects the detection of an occupant in the bed. If a load cell cable 118 is disconnected from the wireless alarm-control device then the instrumentation operational amplifier circuit of FIG. 3 will emit a signal which represents the maximum weight possible and exceeds the maximum allowed preset sensitivity threshold value. In this case, the MCU will detect a maximum weight condition and emit sound during the alarm period. If a load cell assembly 116 is removed from beneath a bedpost 114, then the MCU will detect a weight measurement below the weight of the empty bed and emit an alarm during the alarm period. If the AC-to-DC power supply 124 is disconnected then the battery backup will provide power to the device for continued operation. The enclosure of the wireless alarm-control device 120 is lockable to prevent further manual tampering of alarms. During an alarm period, the only way to silence the alarm is for the occupant to exit the bed.

I would like to conclude the description of the operation of this embodiment with an example use-case scenario. An occupant of a bed attaches group of load cell assemblies to the bed. The occupant connects the load cell assemblies to an accompanying wireless alarm-control device. The occupant connects a power supply and installs a backup battery to the wireless alarm-control device. The occupant locks the enclosure of the wireless alarm-control device to prevent manual tampering. The occupant uses a wireless-communication enabled personal computing device to connect to the wireless alarm-control device. The occupant uses the personal computing device to configure the minimal set of parameters:

the number of sensors attached to the bed;

the appropriate sensitivity threshold value of the sensors; and calibration of the sensors to the weight of the empty bed.

The occupant uses the personal computing device to configure an alarm with the following parameters:

an appropriate name for a daily alarm;

a recurring alarm type set to occur Monday through Friday each week;

a turn-on time of 6:00 AM;

a turn-off time of 5:00 PM;

a maximum volume; and a basic alarm sound pattern.

Each morning at 6:00 AM when the alarm turns on, the occupant of the bed must exit the bed in order for the alarm to silence itself. Since the occupant cannot disable the alarm or manually tamper with the alarm by other means, there is no alternative for the occupant other than exiting the bed and not returning until after the turn-off time has elapsed.

CONCLUSION, RAMIFICATIONS, AND SCOPE

Accordingly the reader will see that, according to one embodiment of the invention, I have provided a wake-up alarm that can enable itself at a specified turn-on time, emit an alarm while the occupant is in bed, automatically silence itself while the occupant is not in bed, disable itself at a specified turn-off time, and resist tampering during the alarm period. Furthermore, the wake-up alarm has the additional advantages in that:

it helps the occupant of the bed overcome sleep-inertia to a fully-awoken state;

it prevents the occupant of the bed, in a state of sleep-induced weakness, from disabling or delaying the alarm and possibly oversleeping;

it eliminates the need for a snooze button found on traditional alarm clocks;

it eliminates the requirement for an integrated time-display;

it eliminates the requirement for integrated user-input components;

it allows the occupant to configure and save multiple alarms on one device;

it automatically synchronizes its current time to that of the personal computing device of the occupant, thereby eliminating the need for manually configuring the time; and it can be used to collect weight measurement data over time in order to evaluate sleep quality or for other medical purposes.

While the above description contains many specificities, these should not be construed as limitations on the scope of any embodiment, but as exemplifications of various embodiments thereof. Many other ramifications and variations are possible within the teachings of the various embodiments. For example, Beam or S-Beam type load cells can be permanently integrated into the structure of the bed frame to hold the sleeping surface. Canister type load cells can be permanently integrated into the structure of each bedpost. The wireless alarm-control device can be permanently installed into the bed frame at the time of the bed frame's manufacture. Alternative methods of detecting an occupant of a bed can be used such as, but not limited to, passive infrared sensors, thermal sensors, or optical sensors and cameras. These sensors, along with alternative types of weight sensors, can be used in a sleeping surface other than a bed such as a sleeping pad, mattress, etc. Alternative methods of wireless communication can be used such as, but not limited to, ZigBee (IEEE 802.15.4), WiFi (IEEE 802.11), Bluetooth, or ANT protocol. Alternative methods for providing a backup battery include using an internal rechargeable battery instead of a disposable battery. Alternative methods for sounding an alarm include using the speaker of the personal computing device instead of the wireless alarm-control device. Alternative methods of time-keeping include using a Real-Time Clock (RTC) integrated circuit.

Thus the scope should be determined by the appended claims and their legal equivalents, and not by the examples given.

The invention claimed is:

1. A machine for providing an audible alarm to wake an occupant of a bed comprising:

a. a plurality of weight sensors attached to said bed which support the total weight of said occupant;

b. an amplifier circuit connected to said weight sensors which converts the weight applied to said weight sensors into corresponding electrical signals;

c. a micro-controller unit executing a firmware program which converts said electrical signals into a digital value, is capable of calculating the difference of multiple digital values, and performs clock and calendar functions;

d. a memory storage device connected to said micro-controller unit which stores a reference digital value of said bed without any occupant, a sensitivity threshold value, an alarm period defined by a turn-on time value and a turn-off time value;

e. a wireless communication device connected to said micro-controller unit which communicates with a personal computing device capable of wireless communication;

f. a speaker circuit connected to said micro-controller unit which is capable of emitting an alarm sound;

g. a software program executed on said personal computing device which is capable of configuring parameters of the micro-controller unit including said reference digital value, said sensitivity threshold value, said turn-on time value, said turn-off time value, and the current time; and h. a function of said firmware program for blocking any modification to any of said reference digital value, said sensitivity threshold value, said turn-on time value, said turn-off time value, and said current time during said alarm period in order to prevent disabling said alarm sound, whereby an alarm sound is emitted when a weight exceeding said reference digital value and said sensitivity threshold value is detected by said micro-controller unit during said alarm period.

2. The machine of claim 1 wherein during said alarm period if said weight sensors are disconnected from said amplifier circuit then said micro-controller unit will detect this condition and emit an alarm sound.

3. The machine of claim 1 wherein during said alarm period if said weight sensors are removed from said bed then said micro-controller unit will detect this condition and emit an alarm sound.

4. The machine of claim 1 wherein an enclosure for said amplifier circuit, said micro-controller unit, said memory storage device, said wireless communication device, and said speaker circuit is capable of being locked or secured to prevent manual tampering.

* * * * *